US007340204B2

(12) United States Patent
Nakazato et al.

(10) Patent No.: US 7,340,204 B2
(45) Date of Patent: Mar. 4, 2008

(54) COLOR IMAGE FORMING APPARATUS AND PROCESS CARTRIDGE THEREFOR

(75) Inventors: Yasushi Nakazato, Tokyo (JP); Masaaki Yamada, Tokyo (JP); Kazumi Suzuki, Kanagawa (JP); Takeo Yamaguchi, Kanagawa (JP); Nekka Matsuura, Kanagawa (JP); Akio Kutsuwada, Tokyo (JP); Seiji Hoshino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 146 days.

(21) Appl. No.: 11/251,870

(22) Filed: Oct. 18, 2005

(65) Prior Publication Data

US 2006/0088337 A1 Apr. 27, 2006

(30) Foreign Application Priority Data

Oct. 25, 2004 (JP) ..... 2004-310225

(51) Int. Cl.
*G03G 15/08* (2006.01)

(52) U.S. Cl. ..... 399/291; 399/223; 399/266

(58) Field of Classification Search ..... 399/291, 399/290, 266, 265, 223, 226, 112, 124, 125; 347/55

See application file for complete search history.

(56) References Cited

U.S. PATENT DOCUMENTS

| | | | | |
|---|---|---|---|---|
| 4,962,723 | A * | 10/1990 | Hotomi | 399/266 |
| 5,298,946 | A * | 3/1994 | Haneda et al. | 399/112 |
| 5,311,258 | A * | 5/1994 | Brewington et al. | 399/266 |
| 5,444,515 | A * | 8/1995 | Haneda et al. | 399/112 |
| 6,134,412 | A * | 10/2000 | Thompson | 399/266 |
| 6,400,921 | B1 * | 6/2002 | Leclerc et al. | 399/266 |
| 6,708,014 | B2 * | 3/2004 | Miyaguchi et al. | 399/266 |
| 6,895,202 | B2 * | 5/2005 | LeStrange et al. | 399/266 |
| 6,901,231 | B1 * | 5/2005 | Sakai et al. | 399/266 |
| 6,901,232 | B2 * | 5/2005 | Sakuma et al. | 399/266 |
| 6,934,496 | B2 * | 8/2005 | Sakuma et al. | 399/265 |
| 2006/0002738 | A1 * | 1/2006 | Kurita | 399/124 |
| 2006/0294252 | A1 | 12/2006 | Shoji et al. | |
| 2007/0086811 | A1 | 4/2007 | Tsukamoto et al. | |

FOREIGN PATENT DOCUMENTS

| | | |
|---|---|---|
| JP | 3-21967 | 1/1991 |
| JP | 8-339110 | 12/1996 |
| JP | 2004-198744 | 7/2004 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A color image forming apparatus including a first-color developing unit configured to form a toner image on the photoconductive belt; and a second-color developing unit and successive developing units, at least the second-color and successive developing units each include an electrostatic developing unit including, an electrostatic toner conveying device including a plurality of electrodes, and a toner feeding device configured to feed the toner to the electrostatic toner conveying device, wherein voltages applied to the plurality of electrodes form a traveling-wave electric field for electrostatically transferring the toner, an electric field for causing the toner to electrostatically move toward the latent image formed on the photoconductive belt is formed, and toners not moved toward the latent image are directly conveyed to the toner feeding device by the electrostatic toner conveying device.

11 Claims, 13 Drawing Sheets

COLOR IMAGE FORMING APPARATUS AND PROCESS CARTRIDGE THEREFOR

BACKGROUND OF THE INVENTION

1. Field of the Invention

The present invention relates to a color copier, printer, facsimile apparatus or similar color image forming apparatus of the type charging a photoconductive belt with a charger, exposing the charged surface of the belt with an exposing unit imagewise to thereby form a latent image thereon, developing the latent image with a developing unit to thereby form a toner image, repeating such a sequence of steps to form toner images of different colors on the belt one above the other and transferring the resulting composite color image to a recording medium with an image transferring unit, and a process cartridge therefore.

2. Description of the Background Art

Japanese patent laid-open publication No. 8-339110, for example, discloses a color image forming apparatus of the type forming toner images of different colors on a single photoconductive belt one above the other and transferring the resulting composite toner image to a recording medium. This type of color image forming apparatus, sometimes referred to as an image-on-image type color image forming apparatus, has a critical problem left unsolved, as will be described hereinafter.

Assume that a developing unit that forms a toner image on a photoconductive belt first is a first-color developing unit while developing units following it are a second-color and successive developing units. Then, the second-color and successive developing units sequentially form toner images of respective colors on the photoconductive belt over the toner image already formed by the first-color developing unit. At this instant, it is likely that part of toner, constituting the toner image formed on the belt first, is introduced into the second-color and successive developing units, disturbing the original colors of developers stored in the second and successive developing units. This degrades the quality of a composite toner image formed on the belt to a critical degree.

SUMMARY OF THE INVENTION

It is an object of the present invention to provide a color image forming apparatus capable of solving the problem stated above and a process cartridge therefore.

A color image forming apparatus of the present invention charges the surface of a photoconductive belt with a charger, exposes the charged surface with an exposing unit imagewise to thereby electrostatically form a latent image thereon, develops the latent image with a developing unit to thereby form a corresponding toner image, repeats such a sequence of steps a plurality of times to form toner images of different colors on the photoconductive belt one above the other, and transfers the resulting composite color image to a recording medium with an image transferring unit. Assume that the developing unit for forming a toner image on the photoconductive belt first is a first-color developing unit and that the other developing units are a second-color and successive developing unit. Then, at least the second-color and successive developing units each are implemented as an electrostatic developing unit including an electrostatic toner conveying device having a great number of electrodes arranged at preselected small intervals in a direction of toner conveyance and each extending in a direction substantially perpendicular to the direction of toner conveyance. Voltages are applied to the great number of electrodes such that a traveling-wave electric field for electrostatically transferring the toner is formed and such that an electric field for development for causing the toner to electrostatically move toward the latent image formed on the photoconductive belt is formed.

At least one of the chargers, developing units and a cleaning unit configured to clean the photoconductive belt after an image transfer and the photoconductive belt may be constructed into a single process cartridge bodily removable from a body of the image forming apparatus described above.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
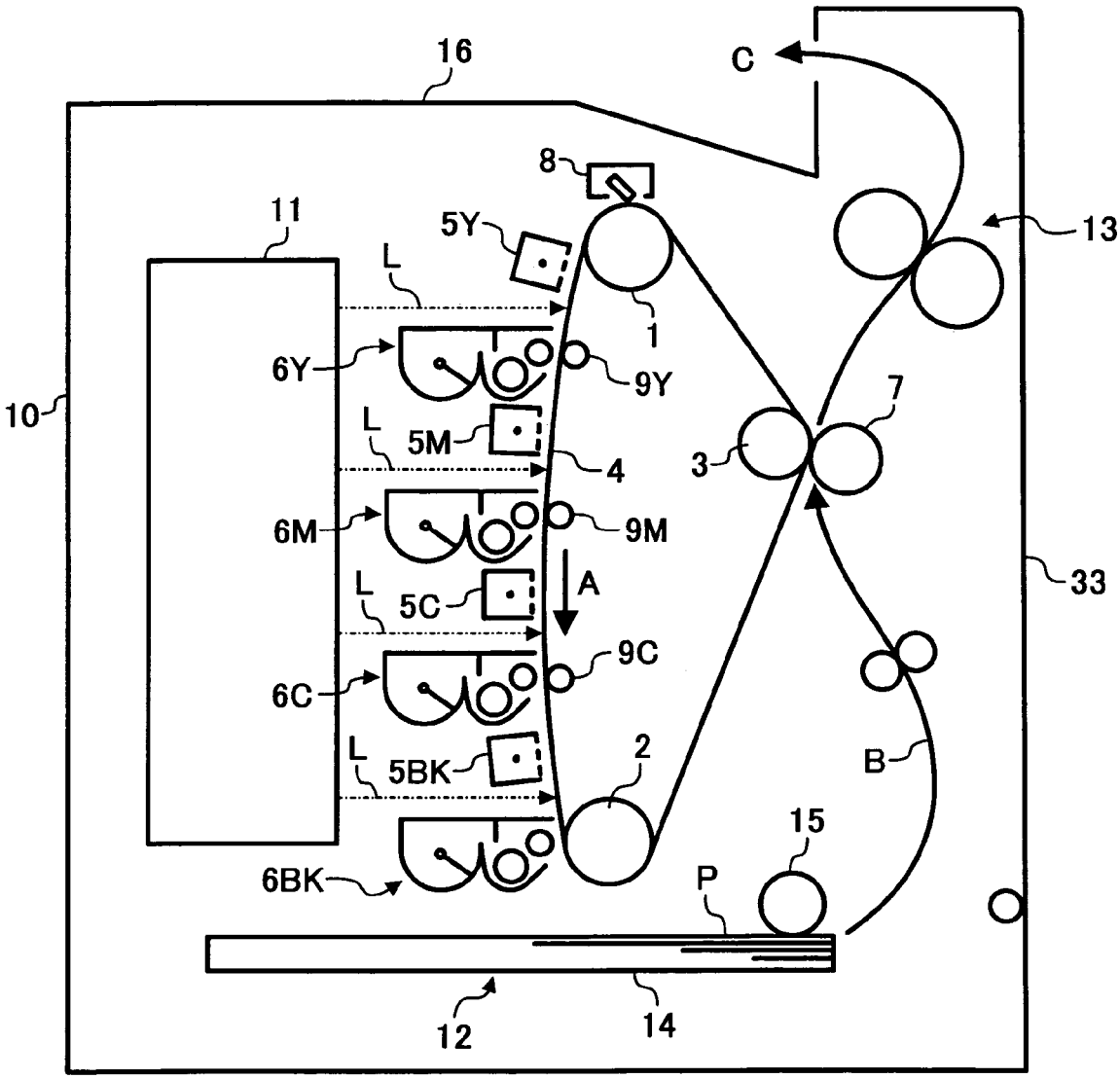
FIG. 1 is a section showing the general construction of a color image forming apparatus embodying the present invention.

Referring to FIG. 1 of the drawings, a color image forming apparatus embodying the present invention is shown and implemented as an image-on-image type color image forming apparatus. As shown, the color image forming apparatus includes an endless photoconductive belt 4 passed over a plurality of rollers including rollers 1, 2 and 3. A first, a second, a third and a fourth charger 5Y, 5M, 5C and 5BK, respectively, a first, a second, a third and a fourth developing unit 6Y, 6M, 6C and 6BK, respectively, an image transferring unit 7 and a cleaning unit 8 are arranged around the photoconductive belt 4. The image transferring unit 7 is implemented as an image transfer roller held in contact with the photoconductive belt 4.

In the illustrative embodiment, the first to fourth developing units 6Y through 6BK respectively form a yellow, a magenta, a cyan and a black toner image on the photoconductive belt 4 (simply referred to as a belt 4 hereinafter). The configuration of the developing units 6Y through 6BK will be described specifically later. In the illustrative embodiment, the chargers 5Y through 5BK are implemented by scorotron chargers by way of example.

Backup rollers 9Y, 9M and 9C face the developing units 6Y, 6M and 6C, respectively, with the intermediary of the belt 4. The belt 4 has a conventional structure made up of a base and a photoconductive layer formed thereon.

All the units stated above are accommodated in the apparatus body 10. Further, an exposing unit 11, a sheet feeder 12 and a fixing unit 13 are accommodated in the apparatus body 10.

In operation, the belt 4 is driven to turn in a direction indicated by an arrow A in FIG. 1. In this condition, the first charger 5Y uniformly charges the surface of the belt 4 to preselected polarity which is negative polarity in the illustrative embodiment. Subsequently, the exposing unit 11 scans the surface of the belt 4 thus charged with a laser beam or similar light beam L modulated in accordance with image data, electrostatically forming a first latent image on the above surface of the belt 4. The first latent image is developed by the first developing unit 6Y to become a yellow toner image.

The belt 4, carrying the yellow toner image thereon, is again charged to negative polarity by the second charger 5M and then scanned by a laser beam L emitted from the exposing unit 11 and modulated in accordance with image data. As a result, a second latent image is electrostatically formed on the surface of the belt 4. The second developing unit 6M develops the second latent image to thereby form a magenta toner image over the yellow toner image. Likewise, the third charger 5C charges the belt 4, now carrying a composite yellow and magenta toner image thereon, to negative polarity, and then the exposing unit 11 exposes the charged surface of the belt 4 for thereby forming a third latent image. The third developing unit 6C develops the third latent image to thereby form a cyan toner image over the composite yellow and magenta toner image. Further, the fourth charger 5BK, exposing unit 11 and fourth developing unit 6BK form a black toner image over the composite yellow, magenta and cyan toner image, thereby completing a four-color or full-color toner image.

On the other hand, the sheet feeder 12 includes a sheet cassette 14 loaded with a stack of paper sheets, resin sheets or similar recording media P. A pickup roller 15 pays out the top paper sheet P in a direction indicated by an arrow B in FIG. 1 when caused to rotate. The paper sheet P thus paid out is brought to an image transfer position between the belt 4 and the image transferring unit 7 at preselected timing. The image transferring unit 7, applied with a preselected image transfer voltage, transfers the full-color toner image from the belt 4 to the paper sheet P. The paper sheet P is then conveyed to the fixing unit 13 and has the toner image fixed thereon by heat and pressure. Finally, the paper sheet or print P is driven out to a stacking portion 16 positioned on the top of the apparatus body 10, as indicated by an arrow C in FIG. 1. The cleaning unit 8 removes residual toner left on the belt 4 after the image transfer for thereby preparing the belt 4 for the next image formation.

As stated above, the image-on-image type color image forming apparatus of the illustrative embodiment charges the belt 4 with the charger, exposes the charged surface of the belt 4 with the exposing unit 11 to thereby form a latent image thereon, develops the latent image with the developing unit to thereby form a toner image, repeats such a sequence of steps to form toner images of different colors on the belt 4 one above the other, and transfers the resulting full-color image to the paper sheet P with the image transferring unit 7.

Assume that the first developing unit 6Y that forms a toner image on the belt 4 first is a first-color developing unit while the second to fourth developing units 6M, 6C and 6BK following it are a second-color and successive developing units. Then, the second-color and successive developing units 6M, 6C and 6BK sequentially form toner images of respective colors on the belt 4 over the toner image already formed by the first-color developing unit 6Y. It is therefore necessary to implement the second-color and successive developing units 6M through 6BK as non-contact type developing units, so that the developing units 6M through 6BK do not disturb the toner image previously formed by the first-color developing unit 6Y. Further, it is necessary to prevent the toner, constituting the toner image formed on the belt 4 first, from being introduced into the second-color and successive developing units 6M through 6BK.

It is a common practice with a color image forming apparatus of the type described to cause a developing sleeve to convey a developer deposited thereon. An electric field, causing toner contained in the developer to move in a developing direction and an electric field of the opposite direction are alternately formed between the developing sleeve and a photoconductive belt. As a result, the toner is caused to move back and forth between the sleeve and the belt to thereby develop a latent image without the developing sleeve contacting the photoconductive belt. However, the problem with this type of apparatus is that when the above developing system is applied to the second-color and successive developing units, the electric field, acting in the direction opposite to the developing direction, undesirably causes part of the toner of the toner image already formed on the belt to move toward the developer deposited on the next developing sleeve, resulting in the mixture of colors.

To solve the above problem, in the illustrative embodiment, use is made of an electrostatic developing unit including an electrostatic toner conveying device. The electrostatic developing unit is configured to remain out of contact with the belt 4 and prevent toner deposited on the belt 4 from being returned to the developing device. While this kind of developing scheme should only be applied to the second-color and successive developing units 6M, 6C and 6BK, it is applied to all of the developing units 6Y, 6M, 5C and 6BK in the illustrative embodiment.

Because the electrostatic developing units 6Y through 6 BK, including an electrostatic toner conveying device each, all are provided with a substantially identical configuration, the following description will concentrate on the developing unit 6Y by way of example. Also, an electrostatic toner conveying device itself is taught in, e.g., Japanese patent laid-open publication Nos. 2004-198675 and 2004-198744 and will be only briefly described hereinafter.

Figure 2:
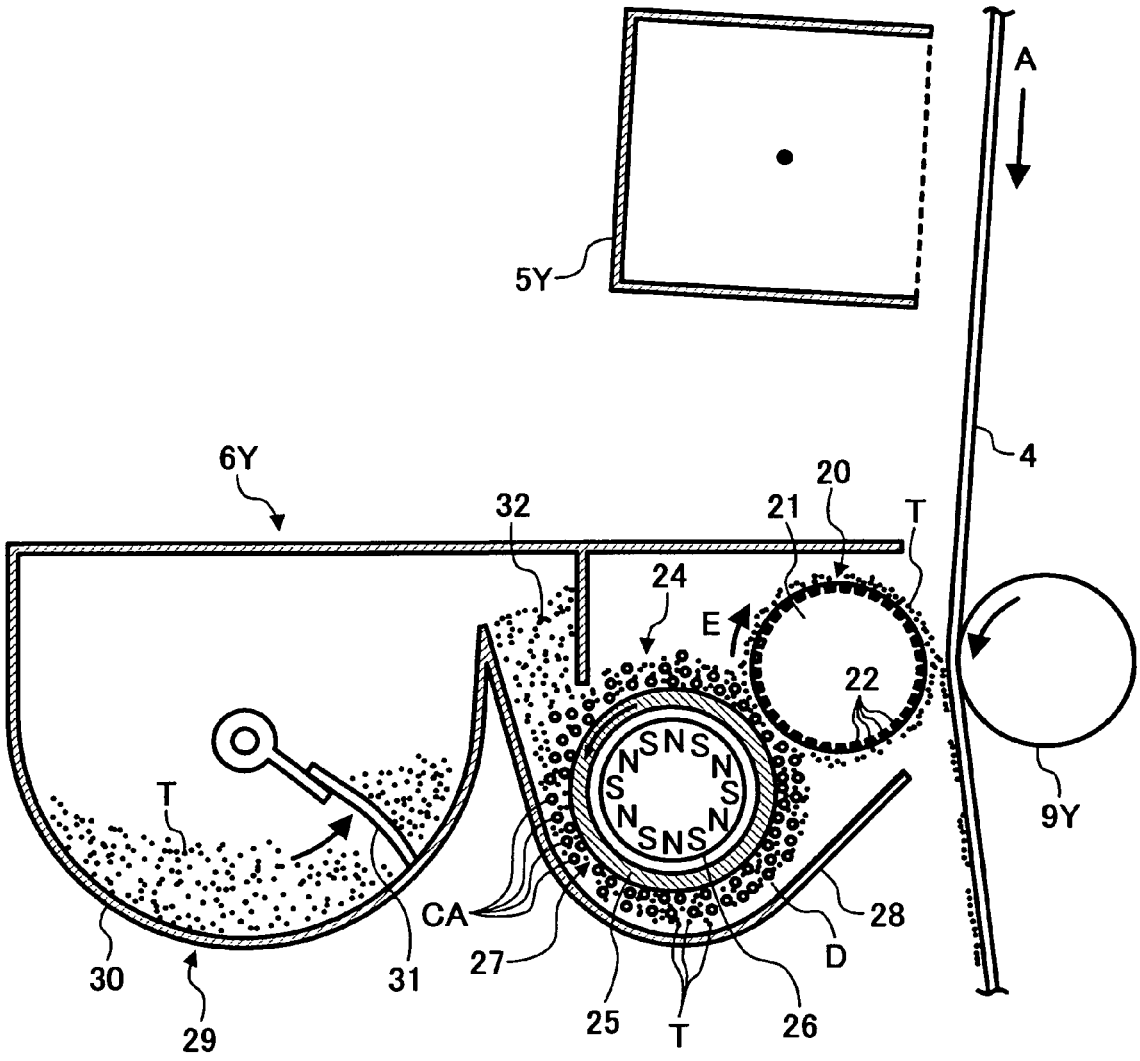
FIG. 2 is a fragmentary enlarged view showing an electrostatic developing unit included in the illustrative embodiment.
Figure 3:
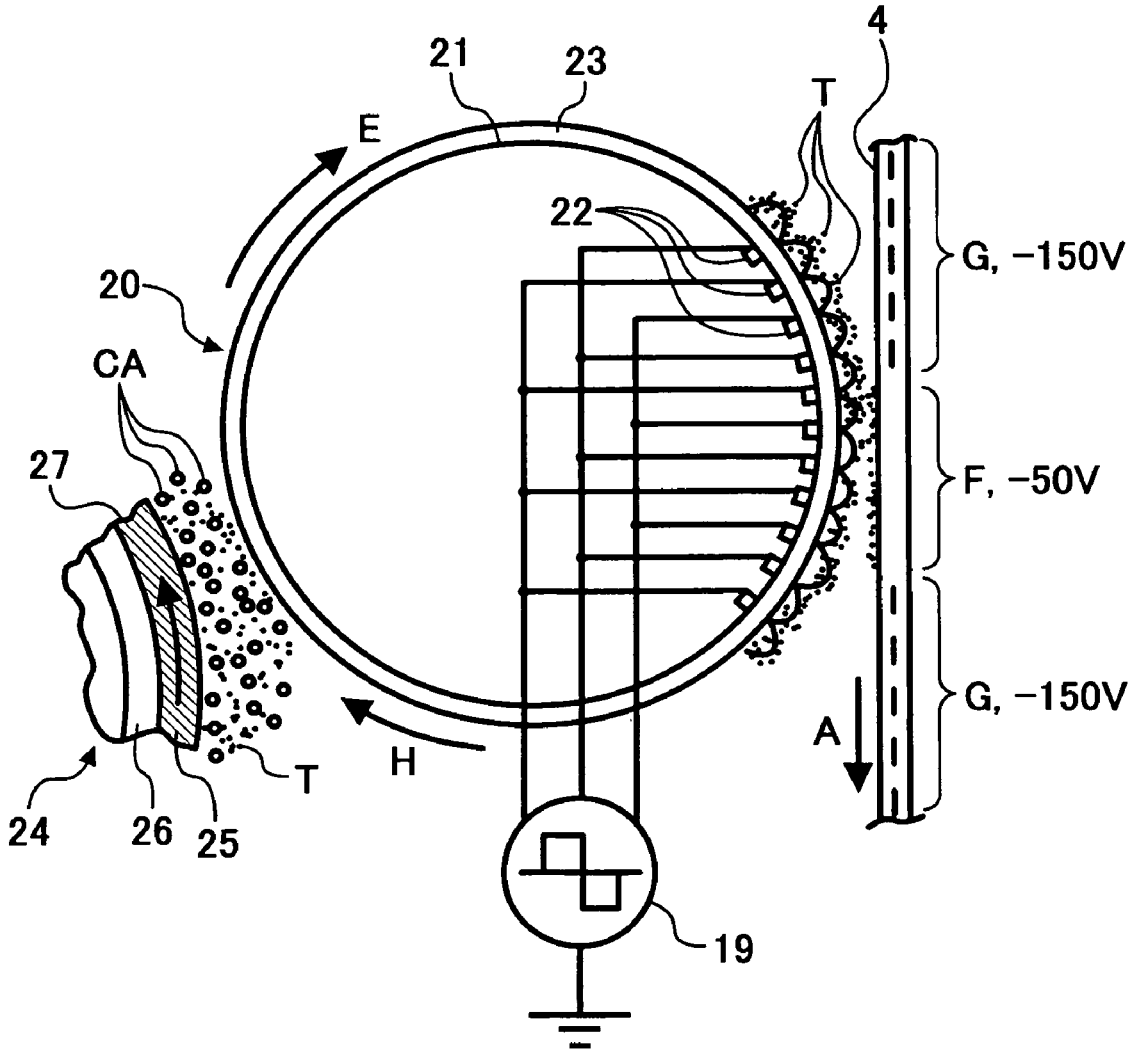
FIG. 3 is a view for describing the operation of an electrostatic toner conveying device included in the electrostatic developing unit of FIG. 1.

FIG. 2 shows an electrostatic toner conveying device 20 included in the developing unit 6Y specifically. As shown, the toner conveying device 20 is spaced from the belt 4 by a preselected distance. As shown in FIG. 3, the electrostatic toner conveying device 20 is made up of a hollow cylindrical support 21 formed of an insulator and a great number of electrodes 22 affixed to the support 21 along the outer periphery of the support 21. An insulating layer 23 is stacked on the outer periphery of the electrodes 22 and support 21. While FIG. 3 shows only part of the great number of electrodes 22, the electrodes 22 are, in practice, arranged on the entire circumference of the support 21, as schematically shown in FIG. 2.

Figure 4:
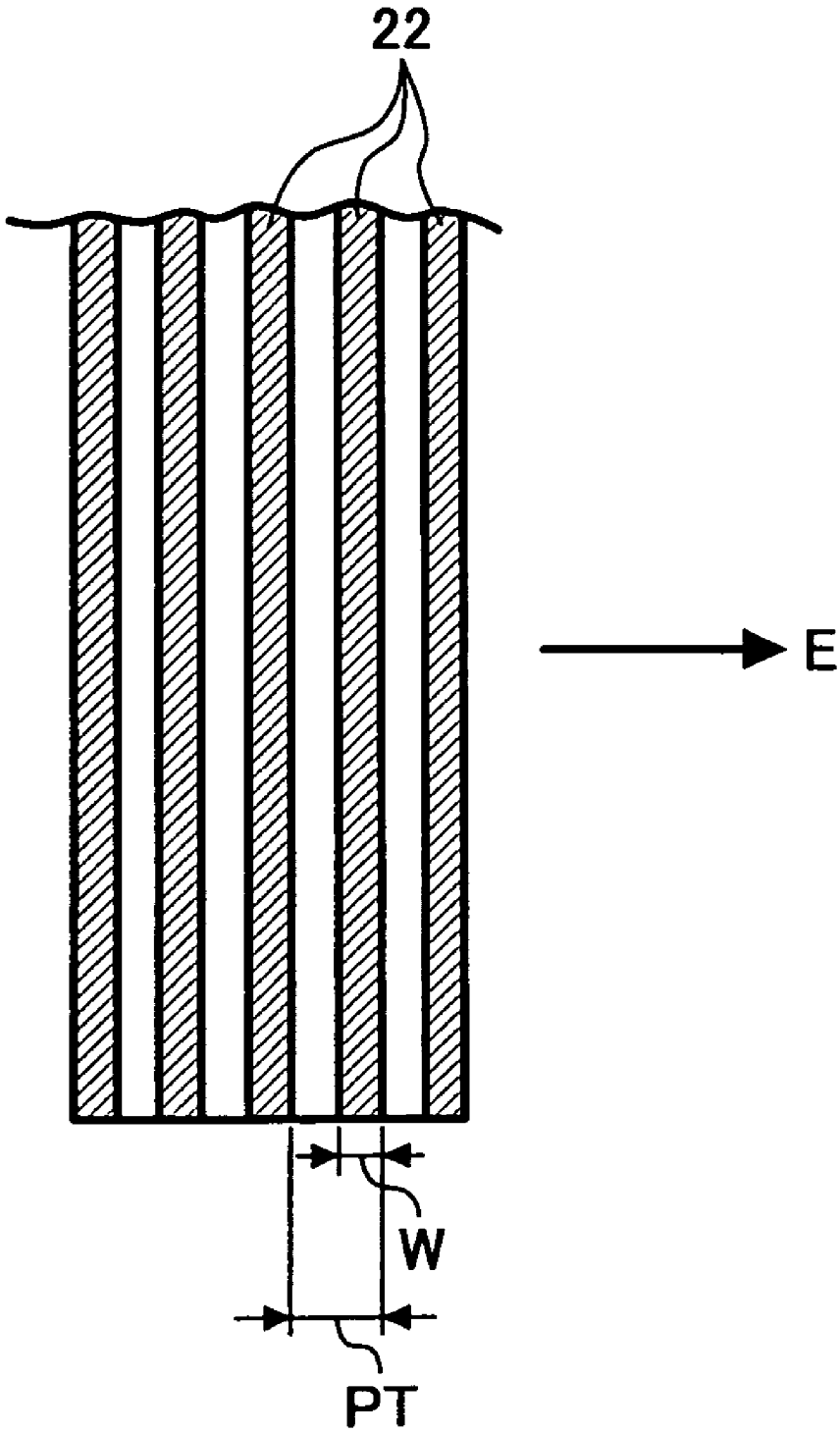
FIG. 4 is a view showing how electrodes are arranged on the electrostatic toner conveying device.

Powdery toner T is conveyed in the circumferential direction of the support 21, as indicated by an arrow E in FIGS. 2 and 3. Each electrode 22 extends in a direction substantially perpendicular to the direction of toner conveyance E over substantially the entire image forming range of the belt 4. Nearby ones of such electrodes 22 are spaced from each other by a small distance along the circumference of the support 21 in the direction E. More specifically, as shown in FIG. 4, the electrodes 22 are arranged at a pitch PT of about 60 μm, and each is provided with a width W of about 30 μm. In FIGS. 2 and 3, toner grains T and carrier grains CA, constituting a two-ingredient type developer in combination, are represented by dots and small circles, respectively. In FIG. 4, the electrodes 22 are indicated by hatching.

As shown in FIG. 3, a three-phase pulse power supply 19 is connected to the electrodes 22 in order to form a traveling-wave electric field for electrostatically conveying the toner T along the outer periphery of the toner conveying device 20 and a developing electric field for causing the toner T to electrostatically move toward a latent image electrostatically formed on the belt 4, as will be described more specifically hereinafter.

Figure 5A:
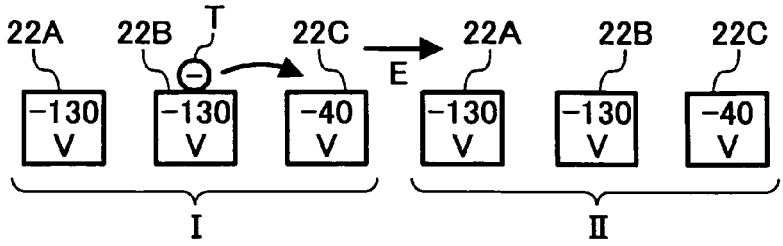
FIGS. 5A through 5D are views demonstrating the principle of toner conveyance executed by the electrostatic toner conveying device.

The great number of electrodes 22 are divided into a plurality of groups each including three electrodes 22. Voltages of three different phases are sequentially applied from the power supply 19 to the three electrodes 22 of each group. FIGS. 5A through 5D show a first group I and a second group II each including three electrodes 22A, 22B and 22C arranged side by side. As shown in FIG. 5A, assume that a toner grain T of negative charge is present on the electrode 22B of the first group I, and that voltages of −130 V, −130 V and −40 V are respectively applied to the electrodes 22A, 22B and 22C of the first and second groups I and II. Then, the toner grain T is electrostatically transferred from the electrode 22B of the first group I to the electrode 22C next to the electrode 22B by an electric field.

Figure 5B:
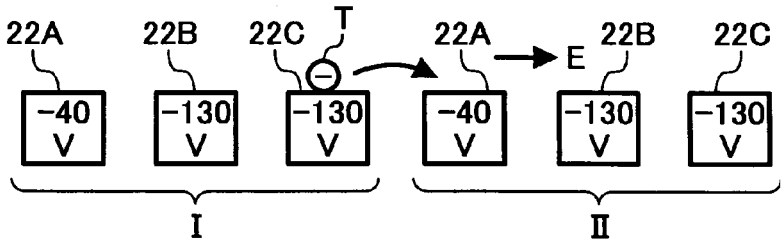
Figure 5C:
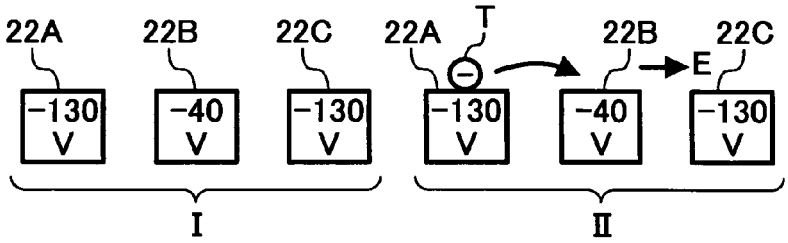
Figure 5D:
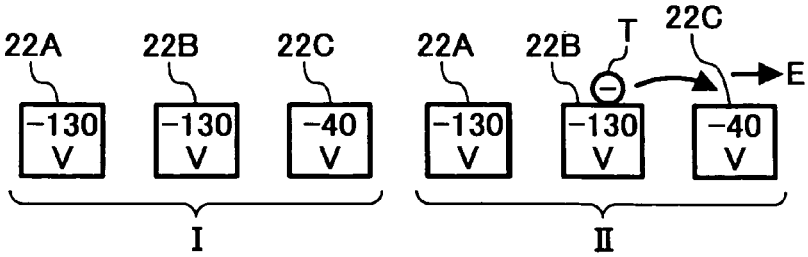

Subsequently, as shown in FIG. 5B, voltages of −40 V, −130 V and −30 V are respectively applied to the electrodes 22A, 22B and 22C of the first and second groups I and II, so that the toner grain T of negative polarity is electrostatically transferred from the electrode 22C of the first group I to the electrode 22A of the second group II adjoining it. Thereafter, as shown in FIG. 5C, voltages of −130 V, −40 V and −130 V are respectively applied to the electrodes 22A, 22B and 22C of the first and second groups, causing the toner grain T to be transferred from the electrode 22A of the second group II to the electrode 22B next to the electrode 22A. Then, as shown in FIG. 5D, the toner grain T is transferred from the electrode 22B to the electrode 22C of the second group II in exactly the same manner. In this manner, the toner grain T is conveyed in a direction indicated by an arrow E in FIGS. 5A through 5D.

The electric field mentioned above is a specific traveling-wave electric field. As shown in FIG. 24, toner grains T are fed from a toner feeding device 24 to the electrostatic toner conveying device 20. The toner grains T are then conveyed by the toner conveying device 20 in the direction E to a developing zone where the belt 4 and conveying device 20 adjoin each other, while hopping on the circumference of the conveying device 20 due to the traveling-wave electric field. At this instant, an electrostatic latent image is present on the belt 4, as stated previously. To form a latent image on the belt 4, the charger 5, FIG. 1, charges the surface of the belt 4, and then the exposing unit 11 selectively scans the charged surface of the belt 4 with the laser beam L image-wise, as stated earlier. For example, assume that the charger 5 charges the surface of the belt 4 to −150 V, that a latent image F formed on the charged surface of the belt 4 has a surface potential of −50 V, and that a background G where the latent image F is absent has a surface potential of −150 V.

On the other hand, it will be seen from FIGS. 5A through 5D that the mean value of the voltages applied to the electrodes 22A, 22B and 22C of each of the first and second groups I and II is −100 V. Consequently, the toner grains T of negative polarity deposited on the toner conveying device 20 and brought to the developing zone are electrostatically transferred only to the latent image F present on the belt 4. In this manner, by applying the above specific voltages to the electrodes, it is possible to form a traveling-wave electric field that causes toner grains to be electrostatically transferred to a latent image formed on the belt 4. Part of the toner grains passed through the developing zone without being transferred to the belt 4 is further conveyed toward the toner feeding device 24 in a direction indicated by an arrow H in FIG. 3 while hopping on the circumference of the toner conveying device 20.

The second-color and successive developing units 6M, 6C and 6BK shown in FIG. 1 perform development in exactly the same manner as the first-color developing device 6Y stated above. At this instant, the developing units 6M through 6BK, each including a respective electrostatic toner conveying device, perform development without contacting the belt 4 like the developing unit 6Y and therefore do not disturb the toner image already formed on the belt 4.

Further, the electric field for development always acts in one or nonreversible direction and therefore prevents toner grains, which constitute the toner image already formed on the belt 4, from being introduced into any one of the second-color and successive developing units 6M through 6BK. It follows that the developing units 6M through 6BK all are free from color mixture and insure high-quality color images over a long period of time. In addition, paper dust and other impurities deposited on the belt 4 are successfully prevented from being introduced in any one of the developing units 6Y through 6BK. It is to be noted that the toner stored in each developing unit may be either one of conventional magnetic toner and non-magnetic toner.

In the illustrative embodiment, the electrodes 22 of each toner conveying device 20 are arranged on an annulus at preselected intervals, as shown in FIGS. 2 and 3, and therefore capable of directly conveying part of the toner not contributed to development toward the toner feeding device 24. Because the toner deposited on the belt 4 is prevented from being introduced in the developing units 6Y through 6BK, it is possible to promote efficient transfer of the toner image from the belt 4 to the paper sheet P. This allows the cleaning unit 8 assigned to the belt 4 to be omitted, if desired.

Moreover, in the illustrative embodiment, a photoconductive element is implemented as an endless belt as distinguished from a drum. Therefore, a plurality of developing units 6Y through 6BK, chargers 5Y through 5BK and so forth can be laid out around the belt 4 with margins. If use is made of a photoconductive drum, then developing units, the drum must be provided with a diameter great enough to allow a plurality of developing units, chargers and so forth to be arranged therearound, increasing the overall size of the image forming apparatus.

Thus, the illustrative embodiment implements an image-on-image type color image forming apparatus having a simple, small size construction.

The toner feeding device 24 shown in FIG. 2 will be described specifically hereinafter. As shown, the toner feeding device 24 includes a developer conveying device 27 made up of a sleeve 25 and a magnet roller 26 disposed in the sleeve 25. South poles and north poles are alternately positioned on the circumference of the magnet roller 26. The sleeve 25 is formed of a nonmagnetic material and causes a dry developer D, which consists of magnetic carrier grains CA and toner grains T, to magnetically deposit thereon.

While the magnet roller 26 is held stationary inside the sleeve 25, the sleeve 25 is rotated counterclockwise, as viewed in FIG. 2, relative to the magnet roller 26. Consequently, the developer D deposited on the sleeve 25 is conveyed counterclockwise with the toner grains T being charged to negative polarity by friction acting between them and the carrier grains CA. At this instant, the carrier grains CA perform, when moving from one magnetic pole of the magnet roller 26 to the next magnetic pole, fine motion as if a magnet brush rolls, so that the agitation of the toner grains T and carrier grains CA is promoted. When the developer D thus agitated is brought to a gap between the sleeve 25 and the electrostatic toner conveying device 20, the toner grains T of the developer D are electrostatically transferred from the sleeve 25 to the electrodes 22 of the device 20 because the voltages stated earlier are applied to the electrodes 22 and because a voltage of, e.g., −600 V is applied to the sleeve 25.

While the toner grains T deposited on the sleeve 25 sometimes contain defective grains not sufficiently charged, such defective toner grains are not transferred to the electrostatic toner conveying device 20 or, if transferred to the device 20, not brought to the developing zone because an electrostatic conveying force acting on the defective grains is extremely weak. Stated another way, only normal toner grains T with expected charge are brought to the developing zone. This obviates toner scattering and background contamination.

In the illustrative embodiment, the sleeve 25 is rotated relative to the stationary magnet roller 26. Alternatively, the magnet roller 26 may be rotated relative to the sleeve 25 held stationary so as to convey the developer D deposited on the sleeve 25. This alternative arrangement allows the sleeve 25 to be constructed integrally with the casing 28 of the developing unit 6Y, if desired. Further, the sleeve 25 and magnet roller 26 may be rotated in opposite directions to each other to convey the developer D deposited on the sleeve 25. If desired, the sleeve 25 may be omitted so as to cause the developer D to directly deposit on the magnet roller 26, in which case the magnet roller 26 is rotated to convey the developer D. Such a configuration contributes a great deal to the simplification of the construction.

In any one of the configurations of the developer conveying device described above, a sleeve, not shown, may be positioned to face either one of the sleeve 25 and magnet roller 26 in order to agitate the developer D deposited on and conveyed by the sleeve 25 or the magnet roller 26, thereby enhancing the electrification of the toner grains T. Alternatively, the doctor blade may be omitted to free the toner grains T and carrier grains CA from excessive stress for thereby reducing the wear of the carrier surfaces.

As stated above, the toner feeding device 24 includes the developer conveying device 27 configured to convey the developer D made up of the toner grains T and carrier grains CA while magnetically retaining them. The toner grains T, being conveyed by the developer conveying device 27 together with the carrier grains CA, are electrified by agitation and then electrostatically fed to the electrostatic toner conveying device 20.

As shown in FIG. 2, the electrostatic developing device 6Y of the illustrative embodiment further includes a toner replenishing device 29 for replenishing fresh toner to the developer conveying device 27. The toner replenishing device 29 includes a toner container 30 formed by part of the casing 28 of the developing device 6Y and a rotatable blade 31. Rotating counterclockwise, as viewed in FIG. 2, the blade 31 scoops up fresh toner T stored in the toner container 30 and replenishes it to the developer conveying device 27.

More specifically, the toner T thus scooped up by the blade 31 is introduced into a space 32, which forms an inlet to the developer conveying device 27, and accumulated therein, as illustrated. The toner T in the above space 32 is replenished to the developer conveying device 27 in an amount corresponding to an amount consumed for development. At the same time, a supplementary amount of toner T is replenished to the space 32 by the blade 31. In this manner, the toner replenishing device 29 automatically replenishes fresh toner to the developer conveying device 27 by an amount consumed for development. With this configuration, it is possible to omit a special device for controlling the toner content of the developer D to be conveyed by the developer conveying device 27 and therefore to simply the configuration of the developing device.

It is a common practice with a color image forming apparatus of the type concerned to charge a photoconductive belt to, e.g., −900 V, exposed the charged surface of the belt to form a latent image thereon such that the surface potential of the latent image is, e.g., about −100 V, and cause toner to deposit on the latent image. In this case, it is necessary to scan the charged surface of the belt with a great quantity of light in order to lower the surface potential of the belt from −900 V to −100 V. However, when the belt, carrying a toner image thereon, is scanned to form a latent image over the toner image, the toner image present on the belt obstructs the propagation of light, preventing a great quantity of light from being incident on the belt.

In light of the above, it has been customary with a conventional image-on-image type color image forming apparatus to use a transparent photoconductive belt and locate an exposing unit at the back of the belt. In this condition, the exposing unit scans the back of the belt for forming a latent image, so that a great quantity of light can be incident on the belt to form an expected latent image without regard to a toner image previously formed on the belt. However, materials applicable to a transparent photoconductive belt are limited. In addition, if the back of the transparent belt is smeared or scratched due to repeated image formation, a great quantity of light is prevented from reaching the belt. Further, the exposing unit, located at the back of the endless belt, noticeably increases the size of the arrangement including the exposing unit and belt.

By contrast, in the illustrative embodiment, at least the second-color and successive developing units each are implemented as an electrostatic developing unit, as stated earlier. It follows that if the belt 4 is charged to, e.g., −150 V and if a latent image of, e.g., −50 V is formed by the laser beam L, as described with reference to FIG. 3, then the latent image can be surely developed by the electrostatic developing unit. In this manner, only by lowering the surface potential of the belt 4 from, e.g., −150 V to −50 V, it is possible to form a latent image on the belt 4. This is why the exposing unit 11 of the illustrative embodiment can surely form a latent image on the belt 4 by emitting the laser beam L toward the outer periphery of the belt 4 without regard to a toner image previously formed on the belt 4. Further, the exposing unit 11, located outside of the belt 4 instead of inside of the belt 4, prevents the belt 4 from being noticeably increased in size.

Moreover, the illustrative embodiment allows the thickness of a charge transport layer included in the belt 4 to be reduced because the absolute value of a potential deposited on the surface of the belt 4 when the belt is charged by the charger is smaller than one, as stated above. It is therefore possible to form a sharp toner image on the belt 4.

As shown in FIG. 1, in the illustrative embodiment, a plurality of developing units 6Y through 6BK are positioned one above the other. The color image forming apparatus with this configuration is prevented from increasing in size in the horizontal direction and therefore occupies a minimum of area when placed on a floor.

Figure 6:
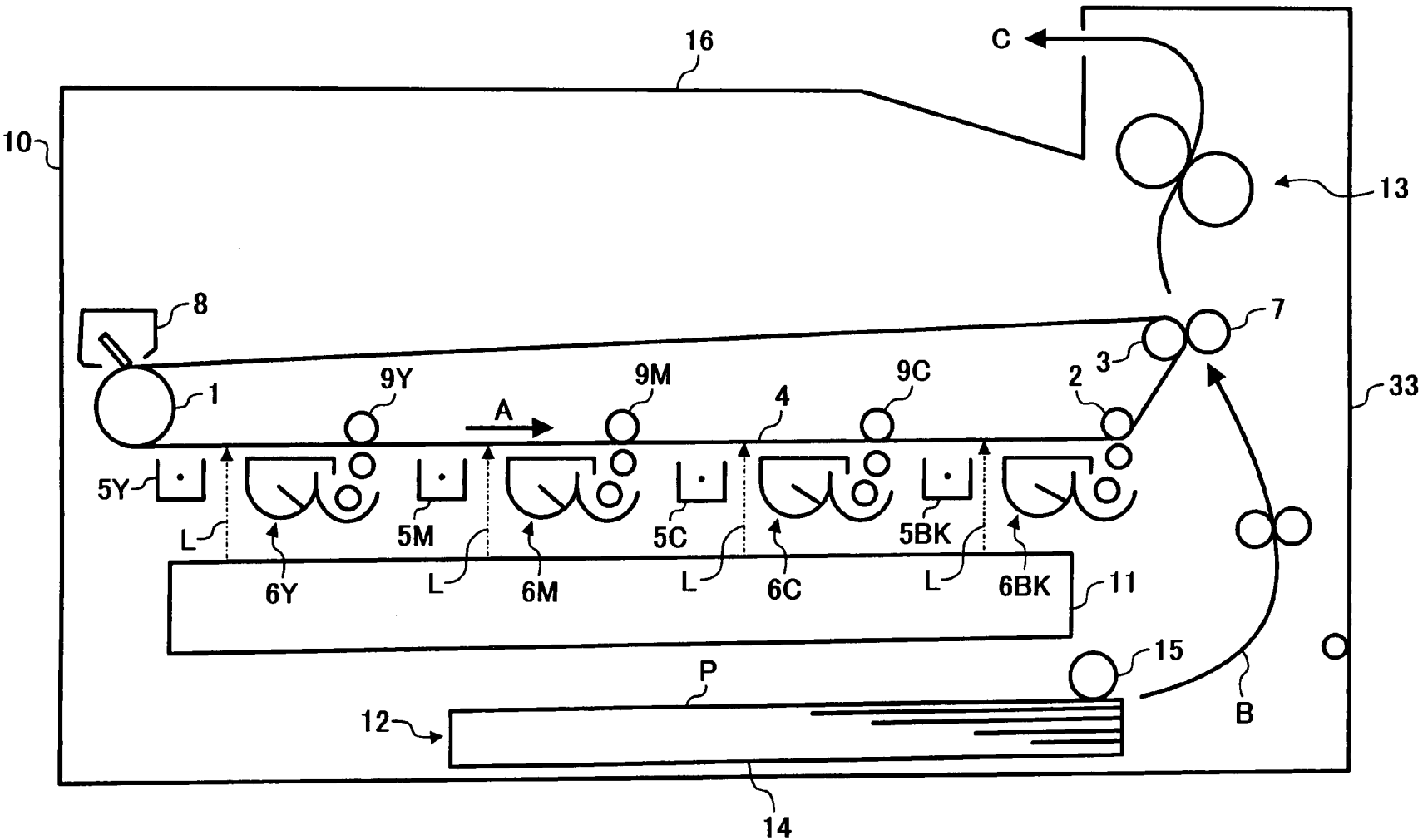
FIG. 6 is a section showing an alternative embodiment of the present invention.

FIG. 6 shows an alternative embodiment of the present invention. As shown, the belt 4 is extended in the horizontal direction while a plurality of developing units 6Y through 6BK are arranged side by side in substantially the horizontal direction. This configuration successfully reduces the height of the apparatus body 10. Further, the distance over which the paper sheet P should be conveyed is reduced. This, in turn, reduces the liability of a jam and the first print time. As for the rest of the construction, the color image forming apparatus shown in FIG. 6 is identical with the apparatus shown in FIG. 1, so that identical structural parts are designated by identical reference numerals.

Figure 7:
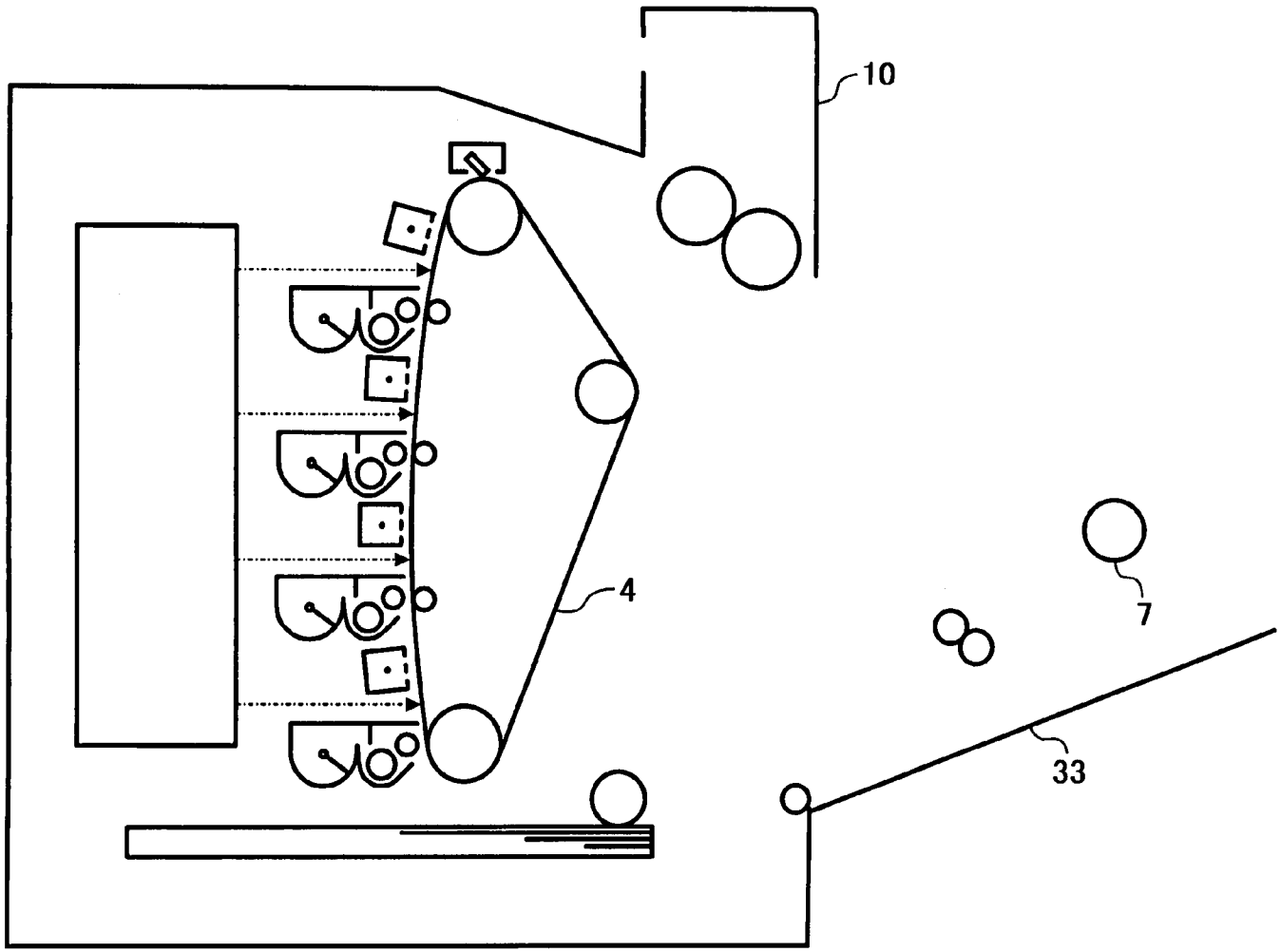
FIG. 7 is a view showing the color image forming apparatus of FIG. 1 in a condition wherein a door thereof is opened.
Figure 8:
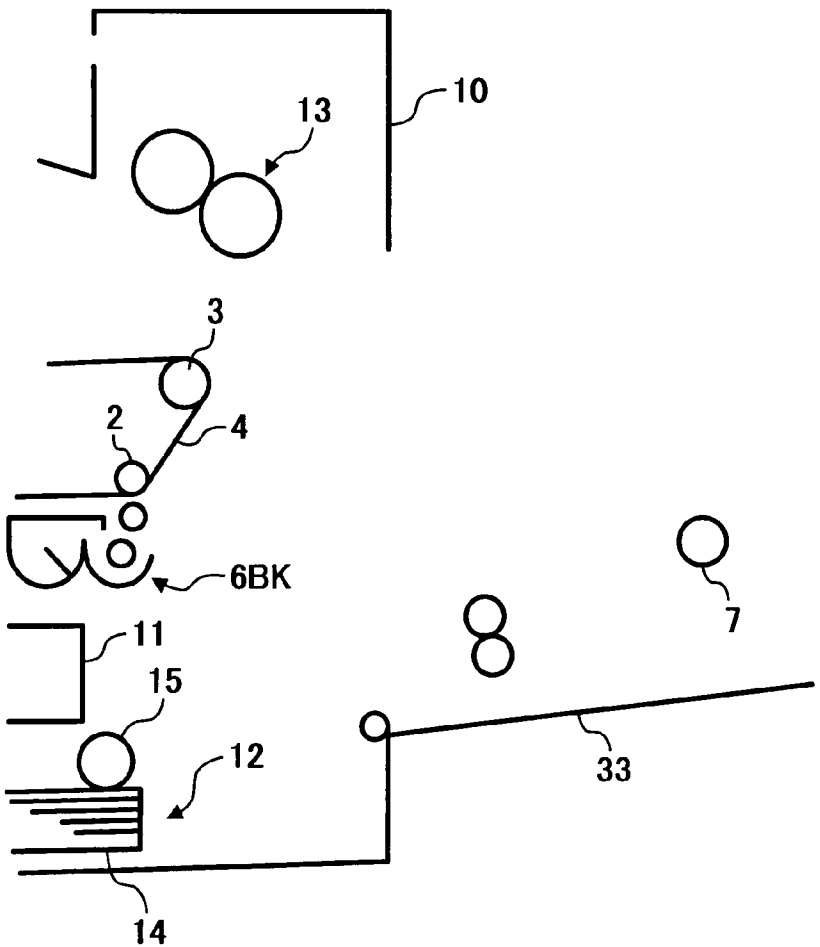
FIG. 8 is a view showing the color image forming apparatus of FIG. 6 in a condition wherein a door thereof is opened.
Figure 9:
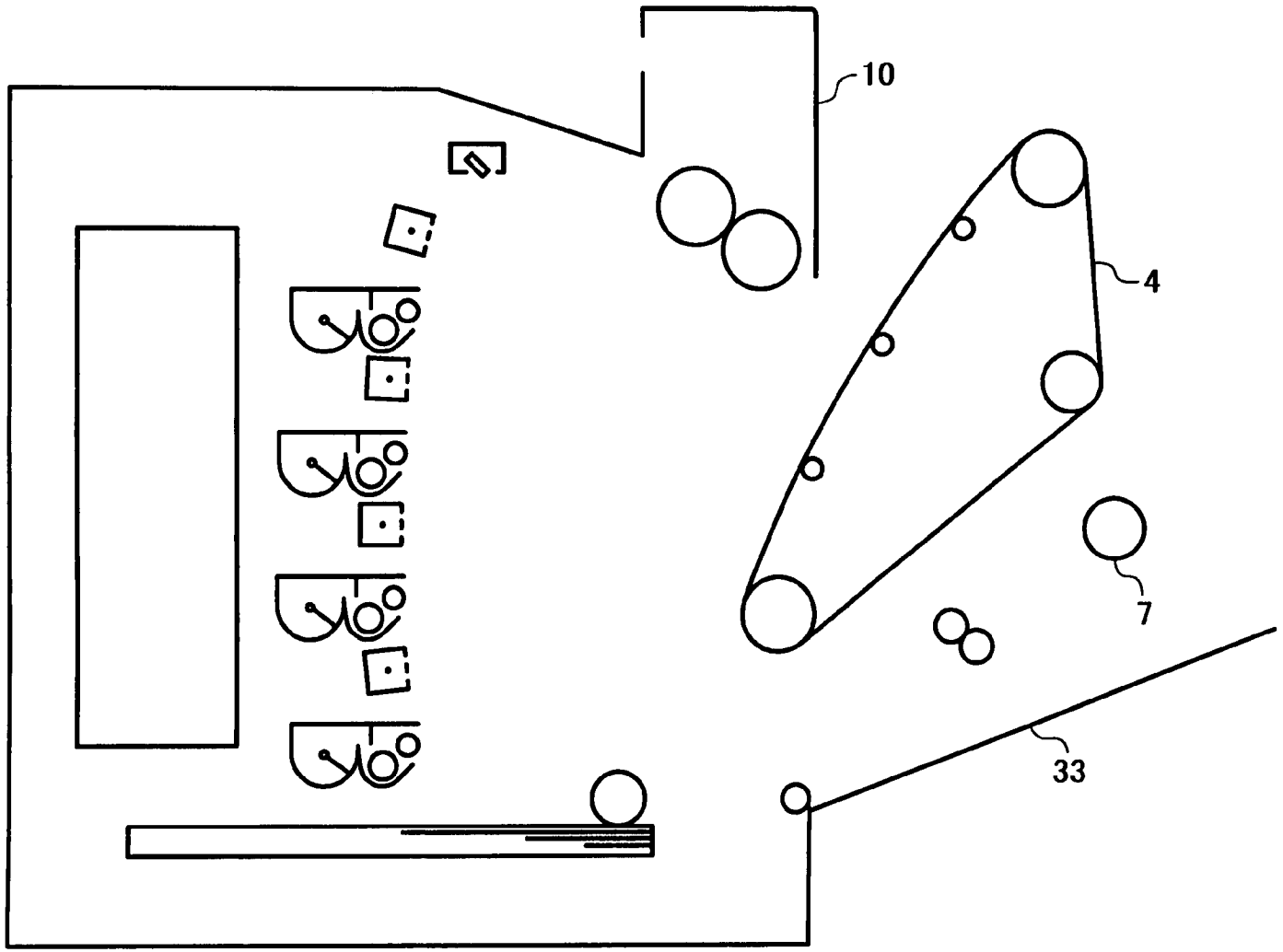
FIG. 9 shows how the photoconductive belt, for example, may be removed from the apparatus body of FIG. 1.
Figure 10:
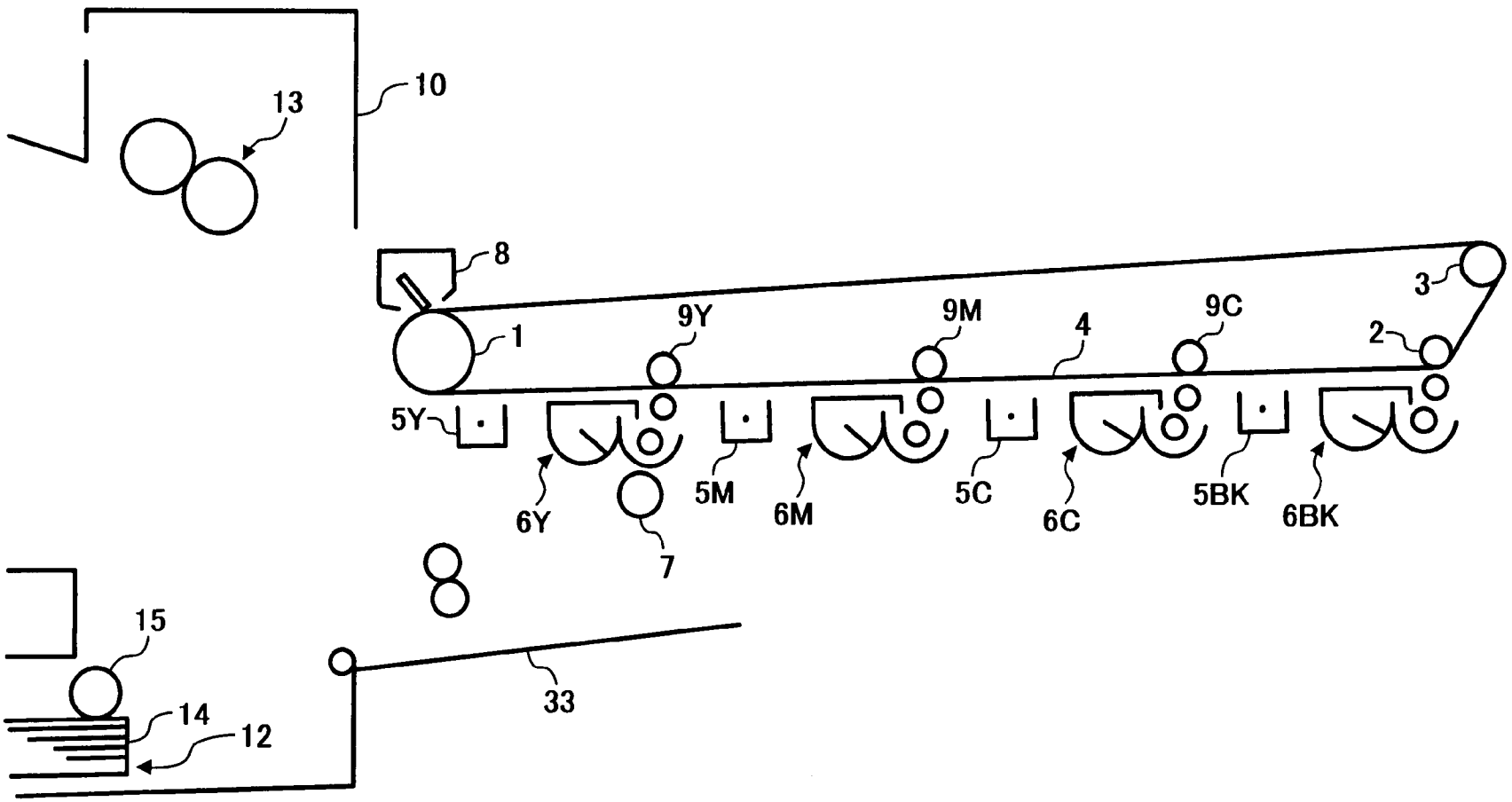
FIG. 10 shows how the photoconductive belt, for example, may be removed from the apparatus body of FIG. 6.

In each of the color image forming apparatuses shown in FIGS. 1 and 6, the right portion of the apparatus body 10 is implemented as an openable door 33 supporting the image transferring device 7. As shown in FIG. 7 or 8, when the door 33 is opened, the image transferring device 7 mounted thereon is moved away from the belt 4, making a sheet path assigned to the paper sheet freely accessible from the outside. In this condition, the operator of the apparatus can easily remove a paper sheet jamming the sheet path. Further, as shown in FIG. 9 or 10, by opening the door 33, the operator can mount or dismount the belt 4 to or from the apparatus body 10.

If desired, the door 33 and part of a cover, not shown, protecting the belt 4 may be configured as guide plates for forming the sheet path assigned to the paper sheet. Also, handle means may be mounted on part of the cover in order to facilitate the removal of the belt 4. In the case where a refeed path for implementing a duplex print mode is arranged at the right-hand side of the image transferring unit 7, the refeed path and image transferring unit 7 should preferably be constructed integrally with each other.

Figure 11:
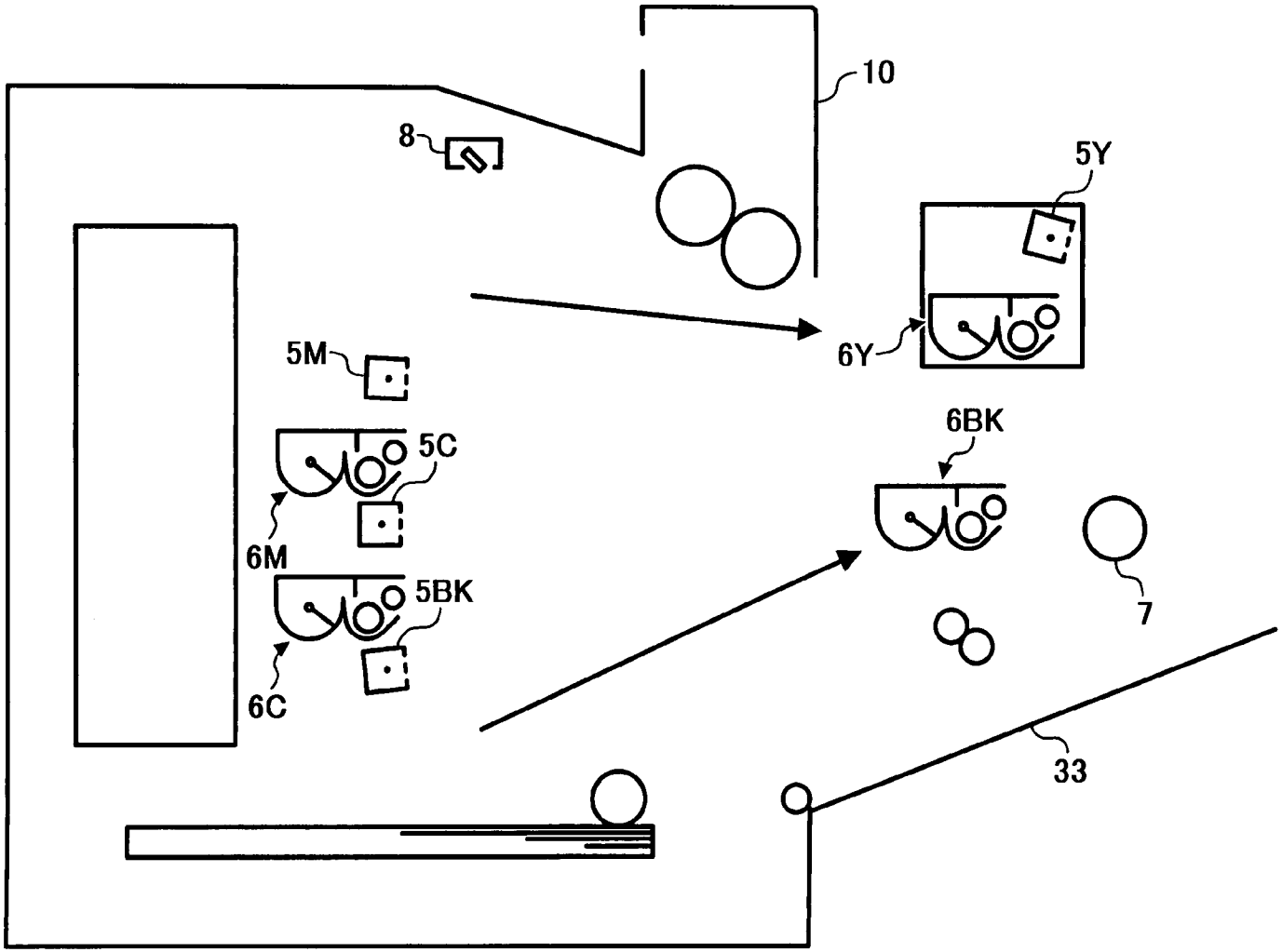
FIG. 11 shows how a developing unit is removed from the apparatus body of FIG. 1.

Furthermore, as shown in FIG. 11, by releasing the image transferring device 7 from the belt 4 and then removing the belt 4 from the apparatus body 10, the operator can mount or dismount at least one of the chargers 5Y through 5BK, developing units 6Y and 6BK and cleaning unit 8 assigned to the belt 4 to or from the apparatus body 10.

As stated above, the illustrative embodiment allows the user of the apparatus to smoothly accurately mount or dismount various kinds of structural parts and elements. Because a single door 33 is mounted on the apparatus body, it is possible to simplify the configuration of the apparatus body 10 and allow the operator to see the inside of the entire apparatus body 10 with a single glance for thereby facilitating maintenance. In addition, should a plurality of doors be mounted on the apparatus body 10, the apparatus would need an exclusive space for the individual door therearound and would therefore be limited as to installation.

Figure 12:
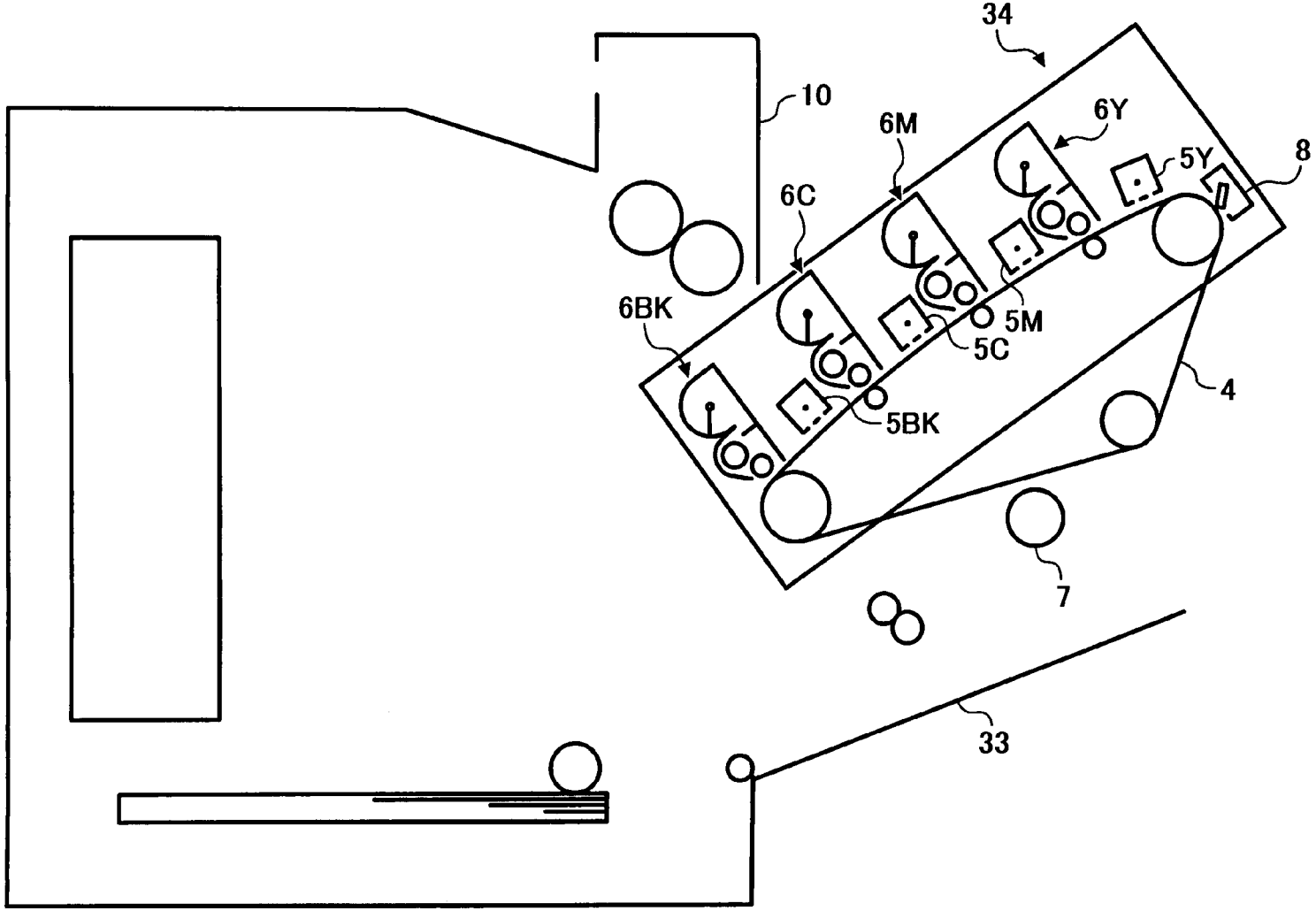
FIG. 12 shows how a process cartridge included in the apparatus of FIG. 1 is removed from the apparatus body.

If desired, at least one of the chargers 5Y through 5BK, developing units 6Y through 6BK and cleaning unit 8 and the belt 4 may be constructed into a single process cartridge and removably mounted to the apparatus body 10. With such a process cartridge, the operator is capable of efficiently mounting or dismounting a plurality of structural elements to or from the apparatus body at once. In this connection, FIG. 12 shows a specific process cartridge 34 on which all the structural elements mentioned above are mounted.

Figure 13:
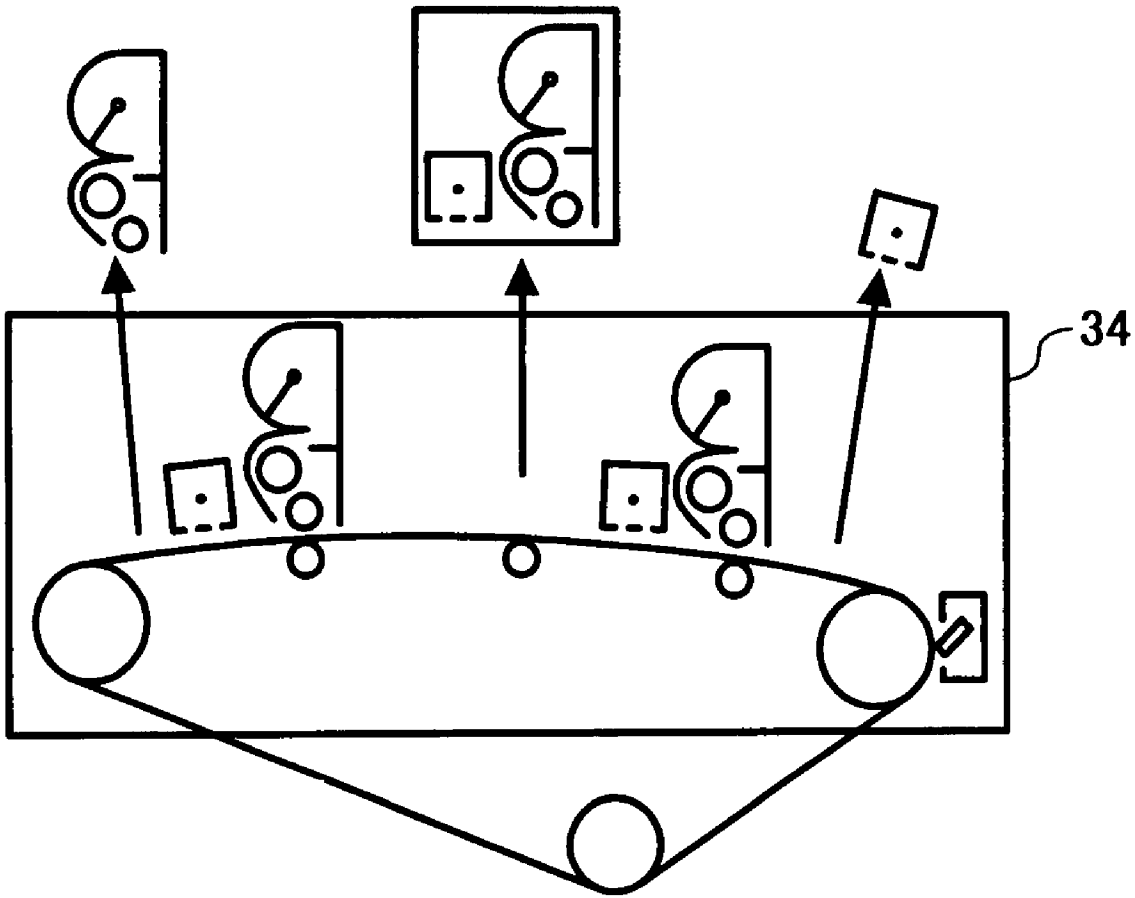
FIG. 13 shows how the structural elements of the process cartridge are removed in the condition shown in FIG. 12.

As shown in FIG. 13, the process cartridge 34 may be configured such that after the removal of the process cartridge 34 from the apparatus body, each structural element thereof can be removed independently of the other structural elements. This configuration allows, when the life of any one of the structural elements ends, the operator to remove the entire process cartridge 34 from the apparatus body and then replace only the unusable structural element, thereby saving cost ascribable to the replacement of still usable structural elements. In addition, it is not necessary for the operator to perform replacement in the limited space of the apparatus body.

The belt 4 and all the developing units 6Y through 6BK may be constructed integrally with each other in order to implement a high quality, image-on-image type process cartridge, if desired.

In summary, it will be seen that the present invention provides a color image forming apparatus and a process cartridge capable of preventing toners of different colors from being mixed together to thereby insure high-quality color images over a long period of time.

Various modifications will become possible for those skilled in the art after receiving the teachings of the present disclosure without departing from the scope thereof.

What is claimed is:

1. A color image forming apparatus configured to execute a sequence of steps of charging a surface of a photoconductive belt with a charger, exposing said surface with an exposing unit imagewise to electrostatically form a latent image on said surface and developing said latent image with a developing unit to form a corresponding toner image, repeat said sequence of steps a plurality of times to form toner images of different colors on said photo conductive belt one above the other and transfer a resulting composite color image to a recording medium with an image transferring unit, the color image forming apparatus comprising:

a first-color developing unit configured to form a toner image on the photoconductive belt; and a second-color developing unit and successive developing units, at least said second-color and successive developing units each comprise an electrostatic developing unit including, an electrostatic toner conveying device comprising a plurality of electrodes arranged on an annulus of the electrostatic toner conveying device at preselected intervals in a direction of toner conveyance and each extending in a direction substantially perpendicular to said direction of toner conveyance, and a toner feeding device configured to feed the toner to said electrostatic toner conveying device, wherein voltages applied to said plurality of electrodes form a traveling-wave electric field for electrostatically transferring the toner, an electric field for causing said toner to electrostatically move toward the latent image formed on said photoconductive belt is formed, and toners not moved toward the latent image are directly conveyed to the toner feeding device by the electrostatic toner conveying device.

2. The apparatus as claimed in claim 1, wherein said toner feeding device comprises a developer conveying device configured to convey a developer made up of magnetic carrier grains and toner grains while magnetically retaining said developer thereon, and the toner grains are electrified by the carrier grains while being conveyed by said developer conveying device and then electrostatically fed to said electrostatic toner conveying device.

3. The apparatus as claimed in claim 2, wherein said electrostatic developing unit further includes a toner replenishing device configured to replenish the toner to said developer conveying device, and said toner replenishing device is configured to automatically replenish the toner by an amount consumed by development.

4. The apparatus as claimed in claim 1, wherein said exposing unit forms the latent image by scanning an outside surface of said photoconductive belt with a light beam.

5. The apparatus as claimed in claim 1, wherein said plurality of developing units are arranged one above the other.

6. The apparatus as claimed in claim 1, wherein said plurality of developing units are arranged side by side in a substantially horizontal direction.

7. The apparatus as claimed in claim 1, wherein said image transferring unit is movable away from said photoconductive belt to open a path assigned to the recording medium, allowing said photoconductive belt to be mounted to or dismounted from a body of said apparatus.

8. The apparatus as claimed in claim 7, wherein when said image transferring unit is moved away from said photoconductive belt and when said photoconductive belt is removed from said body, at least one of said chargers, developing units and a cleaning unit configured to clean said photoconductive belt after an image transfer is removable from said body.

9. The apparatus as claimed in claim 1, wherein at least one of said chargers, said developing units and a cleaning unit configured to clean said photoconductive belt after an image transfer and said photoconductive belt are constructed into a single process cartridge bodily removable from a body of said apparatus.

10. The apparatus as claimed in claim 9, wherein when said process cartridge is removed from said body, any one of structural elements of said process cartridge is removable from said process cartridge.

11. A process cartridge in which at least a photoconductive belt and a plurality of developing units for forming toner images of different colors on said photoconductive belt one above the other, the process cartridge comprising:

a first-color developing unit configured to form a toner image on the photoconductive belt; and a second-color developing unit and successive developing units, at least said second-color and successive developing units each comprise an electrostatic developing unit including, an electrostatic toner conveying device comprising a plurality of electrodes arranged on an annulus of the electrostatic toner conveying device at preselected intervals in a direction of toner conveyance and each extending in a direction substantially perpendicular to said direction of toner conveyance, and a toner feeding device configured to feed the toner to said electrostatic toner conveying device, wherein voltages applied to said plurality of electrodes form a traveling-wave electric field for electrostatically transferring the toner, an electric field for causing said toner to electrostatically move toward the latent image formed on said photoconductive belt is formed, and toners not moved toward the latent image are directly conveyed to the toner feeding device by the electrostatic toner conveying device.

* * * * *